United States Patent [19]

Schäfer

[11] Patent Number: 4,830,430

[45] Date of Patent: May 16, 1989

[54] SPLIT-BACK CHAIR, PARTICULARLY OFFICE CHAIR

[75] Inventor: Stephen Schäfer, Hohenems, Austria

[73] Assignee: Equus Marketing AG, Wald, Switzerland

[21] Appl. No.: 149,106

[22] Filed: Jan. 27, 1988

[30] Foreign Application Priority Data

Jan. 30, 1987 [CH] Switzerland ..... 333/87

[51] Int. Cl.[4] ..... A47C 3/00; B60N 1/10

[52] U.S. Cl. ..... 297/298; 297/296; 297/304

[58] Field of Search ..... 297/297, 298, 296, 299, 297/300, 304, 306

[56] References Cited

U.S. PATENT DOCUMENTS 530,880 12/1894 Briggs, Jr. ..... 397/296 X
764,287 7/1904 Gilson ..... 297/304 X
786,326 4/1905 Travers ..... 297/304

FOREIGN PATENT DOCUMENTS 0107627 2/1984 European Pat. Off. .
523720 4/1931 Fed. Rep. of Germany .
1298392 6/1962 France .
2297021 6/1976 France .

*Primary Examiner*—James T. McCall
*Attorney, Agent, or Firm*—Frishauf, Holtz, Goodman & Woodward

[57] ABSTRACT

To permit adjustment of back parts of the chair, spring means, preferably in form of two U-bent spring rods, couple a lower back part (19) to an upper back part (21) and the effective spring length of the springs (23) is adjustable or changeable by moving a slider (27, 29), connected to one (21) of said back parts, for example via an attachment arrangement (23) of the spring elements themselves, longitudinally of the spring elements. Preferably, a positive stop arrangement to maintain an adjusted position is provided; or the adjusted position may be infinitely variable, for example by clamping the spring element in position by means of an eccentric. The ultimate deflection of the respective back parts can be limited by a stop (36) engaging a stop rod (47') which, simultaneously, can function as a slider guide, the stop rod (47), when springy itself, providing for a stiff terminal spring constant while permitting more easily yielding deflection before its engagement.

20 Claims, 5 Drawing Sheets

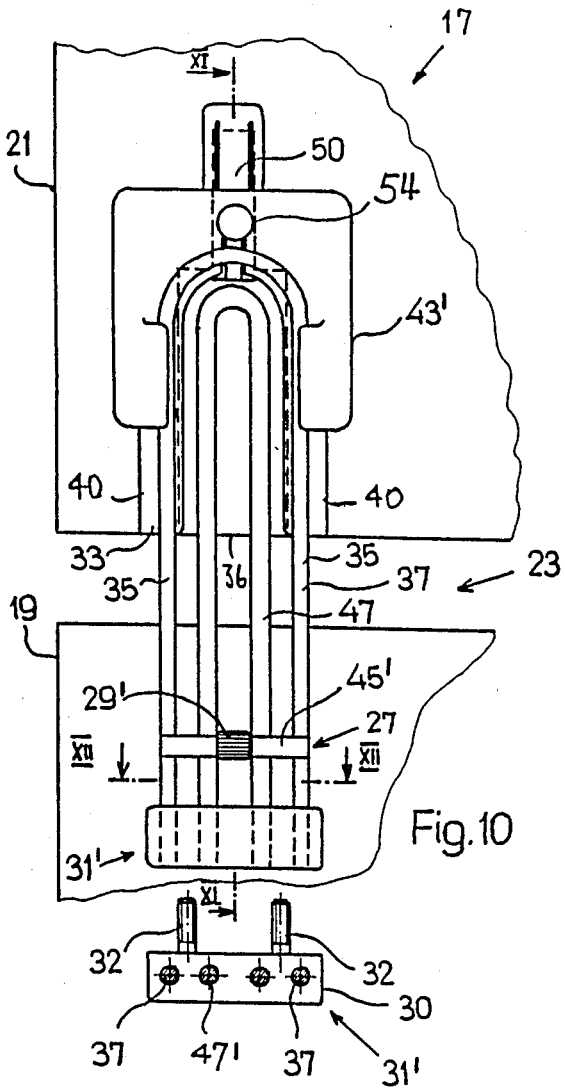
Fig. 10
Fig. 12
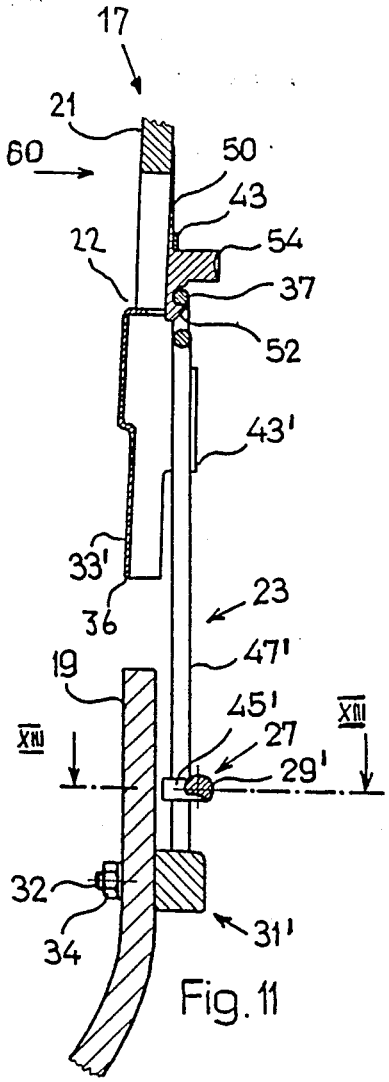
Fig. 11
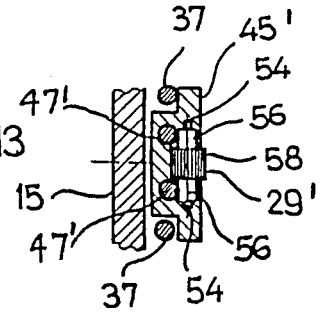
Fig. 13

SPLIT-BACK CHAIR, PARTICULARLY OFFICE CHAIR

REFERENCE TO RELATED PUBLICATIONS

European Patent Application No. 0 107 627, published May 2, 1984, BALLARINI.

French Pat. No. 2 297 021.

French Pat. No. 1 298 392.

German Pat. No. 523 720.

The present invention relates to chairs, and more particularly to the construction of a multi-part back for a chair, especially for an office chair, in which the back and the seat both can tilt.

BACKGROUND

It has previously been proposed (see European Patent Application No. 0 107 627, Ballarini) to construct a chair of multiple back segments. As shown in this reference, five stacked segments are used, connected by four horizontal connections, which form rotary axes. The chair back is bulged slightly towards the rear. When the user leans back, the various segments rotate about their axes, thus increasing the bowing of the back, giving a cradling effect. The shafts about which the axis of rotation occurs are restrained by springs which have the tendency to return the back into its normal position. The back is bowl-shaped, to cradle the user. Thus, the joints which connect the respective segments must be located essentially in the center of the back construction. Lateral arrangement is only possible if the axes of rotation extend parallel to each other. Such an arrangement, however, substantially limits the freedom of the designer in constructing the chair and becomes very costly. Further, the stability of the back is impaired.

It is possible to connect the various back sections by separate rotary joints; it is also possible, however, and as shown in this publication, to connect the segments by linked spring elements in the form of torsion rods or bars. The torsion rods or bars extend from one side of the back to the other, and are retained, rotatably, in the center of the back. The ends of the torsion rods or bars have oppositely bent-over parts secured thereto, for attachment to the respective back segments. To attach two segments, five attachment elements or arrangements are necessary, four for the ends of the torsion rods and one for the center, an expensive and complex arrangement.

Adjustment of the spring pressure is not possible in these arrangements. Thus, the designer is faced with always designing for a compromise. If the user is lightweight, the back is too stiff. If the user is quite heavy, it is too flexible, and does not provide the necessary support; on the contrary, it may lead the user to have a feeling of instability. For a heavy user, the segmented back is less desirable than a single unit back; for a light person, the segmented back is useless and merely excessively complex and expensive.

THE INVENTION

It is an object to improve a chair, and especially the chair back, particularly of an office chair, in which multiple segments can be used, permitting adjustment of relative movable spring force while, at the same time, being simple and inexpensive to manufacture, and giving the designer freedom of choice of appearance.

Briefly, two segments of a back—there may be more—are respectively interconnected by spring elements which couple the back elements together. Adjustable clamps or claws or the like, for example, or slider arrangements, are associated with the spring elements to change the spring force—deflection characteristics of the spring elements connecting the back segments together.

Preferably, the spring elements are essentially vertically extending rods, secured firmly to one of the back elements but slidably or adjustably secured to the other, to which clamping elements may be attached in such a way that the spring force—deflection characteristics of the coupling of the back segments can be changed. In accordance with a preferred feature of the invention, two such rod sections are located at respectively opposite sides of the center line or a plane of symmetry of the back. The rod elements themselves can be dual elements, for example U-shaped springs, in which end portions of the legs of the springs are, respectively, rigidly secured to one of the segments and adjustably to the other, for example by placing an adjustable clamping bar across the U-shaped spring elements at a position in the vicinity of the bend of the U or, alternatively, by providing an adjustable back-up element which itself can be stiff or slightly springy with, however, a substantially stiffer spring constant than the U elements.

Constructing the spring elements as round rod springs results in a simple and inexpensive and readily attached construction. Use of two or more rods, on both sides of the center plane of symmetry of the chair, permits independent adjustment, so that the bowing or cradling of the back of the chair can be adjusted to match the body shape of the user. Further, since the spring elements on either side of the plane of symmetry are independent of each other, the bend-through of the individual spring elements will be independent and follow any horizontal or lateral leaning by the user. The user, thus, has the feel of stability and resistance to his movement while, still, being cradled and held securely.

Constructing the spring element in the form of U-shaped dual spring elements has the additional advantage that the spring elements can be located already on a pre-bowed or cradling-type frame, that is, the planes of the U can extend at an acute angle with respect to the sagittal plane of the chair, or of the user, respectively. Thus, specific use of different connections for the respective sides of the chair is not necessary; nor is it required that the spring elements be located in the same plane. The designer thus has wide latitude.

DRAWINGS

FIG. 10 is a rear elevational view of another embodiment of the invention;

FIG. 11 is a section along line XI—XI of FIG. 10;

FIG.12 is a section along line XII—XII of FIG. 10;

FIG. 13 is a section along line XIII—XIII of FIG. 11;

DETAILED DESCRIPTION

Figure 1:
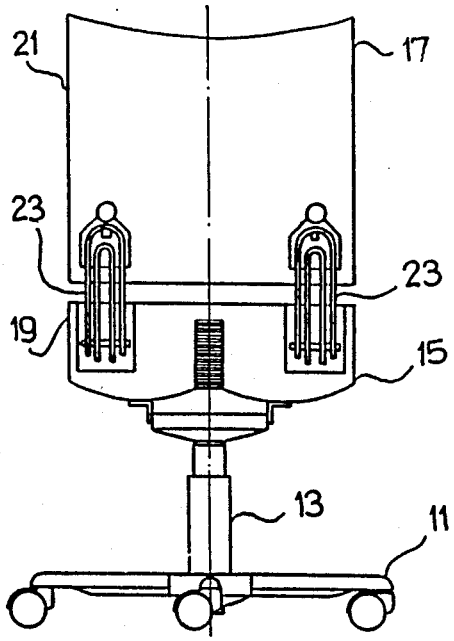
FIG. 1 is a rear elevational view of the chair.
Figure 2:
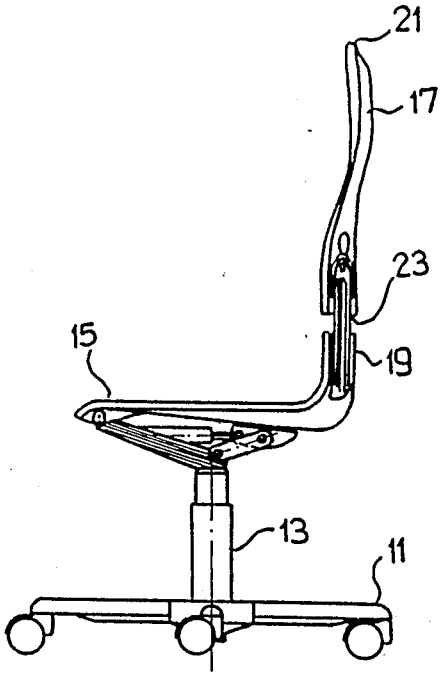
FIG. 2 is a side elevational view of the chair.

The invention will be described in connection with an office chair although, of course, it is equally applicable to other types of chairs as well. Referring first to FIGS. 1 and 2: A base support, formed as a spider 11, for example with casters, retains a center post 13 on which a seat 15 is secured. The seat 15 is connected to the back 17. Seat 15 and back 17 are padded, as usual. In the illustration shown, the padding has been removed so that the adjustment mechanism on the back is clearly visible. The chair may be of the synchronous movement type, in which the back 17 inclines when the seat 15 is inclined, but by only half the angle of inclination as the seat. The present invention is preferably applicable with other types of office chairs, for example where the back moves independently, or is rigidly coupled to the seat. In essence, the presence invention is related to the construction of the back, independently of the remainder of the chair.

Figure 3:
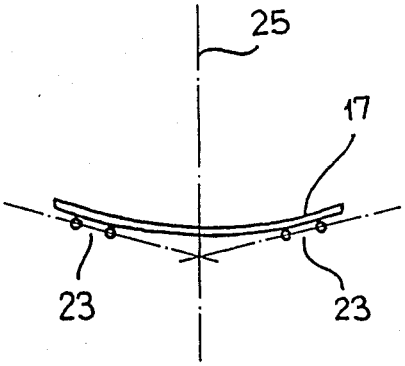
FIG. 3 is a horizontal schematic sectional view through the chair, illustrating the placement of U-shaped spring elements in a cradle-type back.
Figure 8:
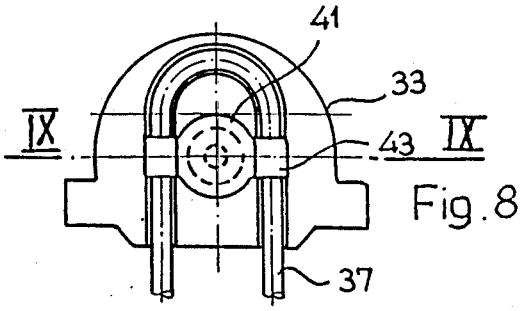
FIG. 8 is a rear elevational view for an upper support of a spring element.
Figure 9:
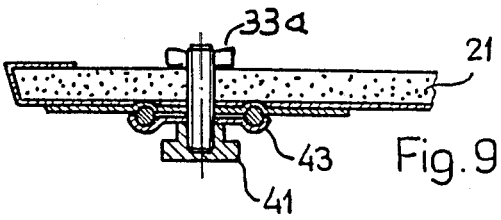
FIG. 9 is a section along line IX—IX of FIG. 8.
Figure 4:
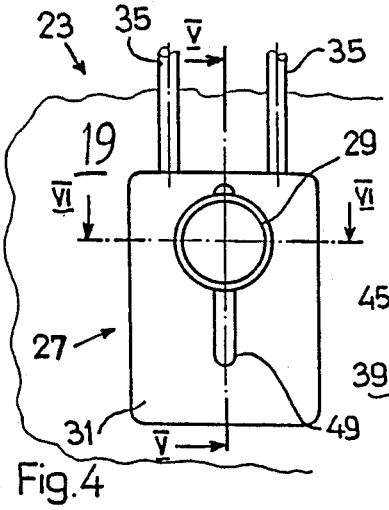
FIG. 4 is a fragmentary enlarged elevation of a first embodiment of the invention, illustrating attachment of a U-spring.
Figure 5:
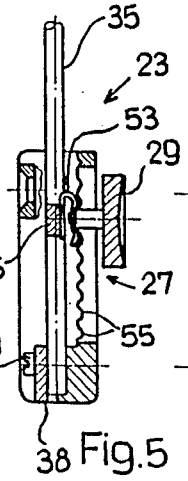
FIG. 5 is a section along line V—V of FIG. 4.
Figure 7:
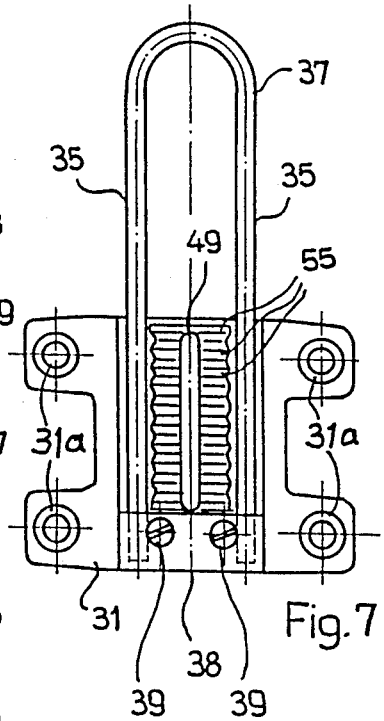
FIG. 7 is a rear elevational view of a support for a spring element.
Figure 6:
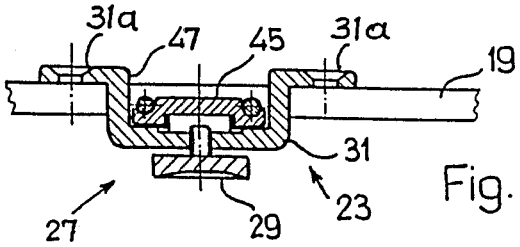
FIG. 6 is a section along line VI—VI of FIG. 4.
Figure 14:
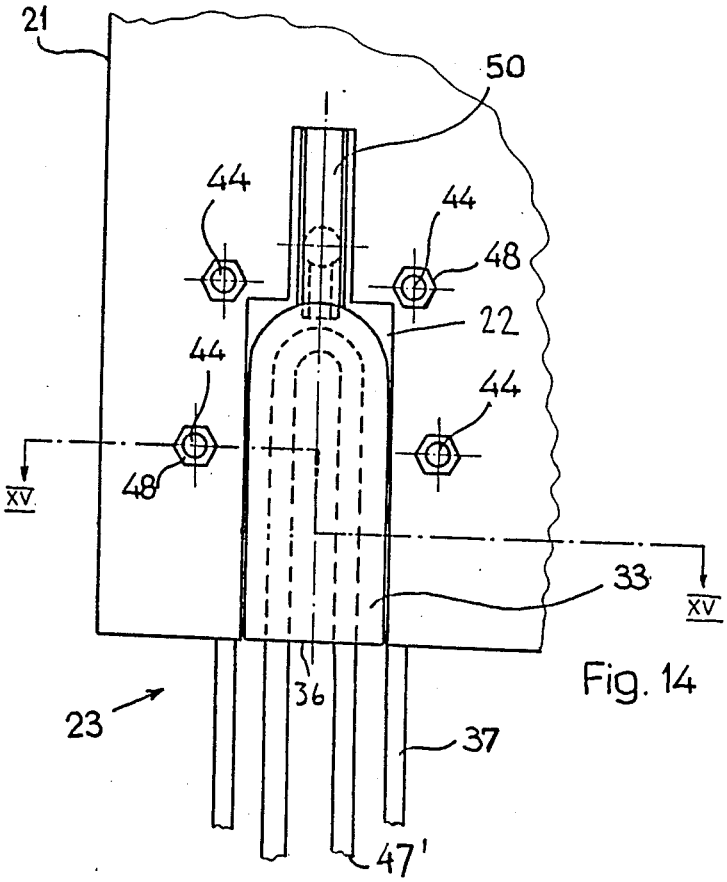
FIG. 14 is a rear elevational view of the upper attachment of a U-spring.
Figure 15:
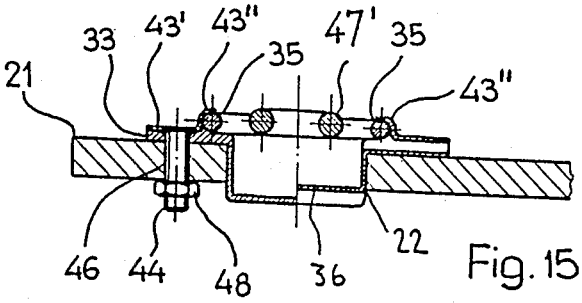
FIG. 15 is a section along the broken section line XV—XV of FIG. 14.

The back 17 includes at least two vertically arranged or superposed or stacked segments 19, 21, which are coupled by two spaced spring links 23. More than two segments may be used although, for most applications, two segments are sufficient. It is, of course, also possible to utilize only a single spring element 23 which, then, would be located at the central plane of symmetry shown by the central or sagittal axis 25 (FIG. 3). More than two spring elements or units 23 may be used.

Frequently, chair backs, and especially office chair backs, are bowl-shaped or somewhat bowed to cradle the user, as schematically shown in FIG. 3. If the back is constructed in such a manner, problems result when the back is split into several sections because an axis of rotation must then extend perpendicularly to the sagittal plane 25. Customary rotary joints, however, cannot be used so that an acute angle is formed by tangents to the curved back, as seen in FIG. 3. Yet, when using spring elements in accordance with the present invention, the curved back can be retained in sections, as will appear, with the connecting lines of U or dual spring units intersecting the sagittal plane at an acute angle-see FIG. 3. Of course, the intersecting lines will be essentially tangential to the curved back.

It is a specific advantage of the present invention that the spring characteristics of multiple springs being used can be independently adjustable. Referring now to FIGS. 4 to 9: Each one of the spring elements 23 are coupled to an arrangement 27 (FIG. 4) which permits independent adjustment by an adjustment element, shown as an adjustment screw 29, to change the spring characteristics of the spring coupling or spring joint. Thus, the user of the chair can select the spring force with which the chair segments can move with respect to each other, thus select harder or softer springing of the chair segments.

The spring link unit 23 is coupled to a first or lower support 31 (FIGS. 4–6) which, in turn, is coupled to the segment 19 of the chair at the lower side; a second support 33 (FIGS. 8 and 9) is coupled to the upper segment 21 of the back 17 of the chair.

Each one of the spring links 23 includes at least one round spring bar 35, made of springy material, for example spring steel. The round bars 35, preferably, are bent in U-shaped form to form U-spring elements 37.

One end of the spring elements 37, formed by the open legs thereof, is secured to the support 31. A clamping jaw 38 is secured by screws 39 to the support base 31 which, in turn, is screwed by screws passing through screw holes 31a into the back section 19 of the back 17. A support 33 is secured to the upper segment 21 with a nut 33a. The upper end of the spring element 37 is clamped to the upper segment 21 by a screw secured to the support 33 and a nut 41, clamping a clamping jaw or bridge 43 to secure the U-spring rods to the upper section 21.

In accordance with a feature of the invention, the spring-deflection characteristic of the spring element 37 can be changed, which includes a changing mechanism essentially formed of a slider 45, which can be shifted in a guide track 47 located in the support 31. The rods 35 of the spring element 37 are engaged by the slider 45 or, alternatively, they are positioned immediately adjacent thereto. In dependence on the position of the slider 45, that is, closer to the top or to the bottom, the effective length of the spring will change, that is, will be less or longer. The path over which the slider 45 can be changed is defined and limited by the slit 49 in the support 31. The slider 45 is coupled to the adjustment element 29 by an engagement spring 53 which can fit in suitable depressions formed in the guide track 47, the engagement spring 53 being undulated so that specific adjustment locations are determined. The adjustment element 29 can be constructed merely in form of a push button to, respectively, engage the spring element 53 in the corrugations 55; alternatively, a camming rotary movement can be provided for locking the element 29 in position.

EMBODIMENT OF FIGS. 10–15

The spring link 23 includes a first support 31′ and a second, upper support 33′. In the embodiments of FIGS. 10–15, essentially similar elements have been given the same reference numeral, with prime notation, as appropriate. Two round rods 35 are bent into U-shape 37. One end of the U-spring element 37 is secured in support 31′ which, for example, is formed as a plastic block 30. Screws 32 are molded into the block 30 which permit attachment of the support 31′ on the segment 19 by nuts 34.

The upper end of the spring element unit 37 is secured by clamp 43′ and the support 33′ to the seat back section or segment 21. The clamp 43 has four threaded studs 44 (FIG. 15) which pass through openings or bores 46 of the segment 21, so that nuts 48 can be applied thereon. The arms 43″ of the clamping bridge 43′ are so dimensioned that the spring elements 37 are not securely clamped, but may slide therein. This permits attachment of the segment 21 on the segment 19, or to remove the segment 21 therefrom, merely by vertically sliding it off.

The support 33′ (FIG. 15) is a plastic element which has an upper springy portion 50 formed with a latch 52, and an operating element, for example a button 54. If, for example, segment 21 is to be attached to segment 19, the latch 52 engages the upper portion of the corresponding spring element 37—see FIG. 11—and holds the spring element in the position shown. To remove the upper segment 21, for example for reupholstering, or for replacement by a larger or smaller element, at the option of a customer, it is only necessary to press on the two buttons 54 on each side of the segment 21, thus releasing the latch hooks of the latches 52 from the respective spring elements 37 and permitting the segment 21 to be vertically removed. Support 33 can be made of plastic or, respectively, as a punched sheet metal element.

Support 33′ has a stop 36 (FIGS. 10 and 14) which has essentially U-shaped cross section. The open ends of the U are outwardly bent over to form flanges 40 (FIG. 12). This arrangement permits insertion of the support 33′ in a slit 22 of the segment 21. Support 33′ is retained in the slit 22, since, by clamping the clamp 43′, flange 40 is pressed against the walls of segment 21.

The spring characteristics of the spring element 37 are changed, in accordance with a feature of the invention, by adjustment of a slider 45′ which can be shifted in position on a guide 47′ of the support 31′.

Referring now to FIG. 11: In quiescent position, when no force in the direction of the arrow 60 acts against the segment 21, spring element 37 is engaged on the slider 45 or is located in the immediate vicinity thereof. In dependence on the position of the slider 45′, that is, further upwardly or lower with respect to FIG. 11, the effective length of the spring element 37 will be smaller or larger. This permits the user to adjust the spring constants of the segments of the chair back 17 as desired, so that the user's requirements, upon leaning back in the chair, will be satisfied. Slider 45′ is coupled to an adjustment element 29′ with which the slider 45′ can be placed in the desired position. The adjustment element 29′ is rotatably retained in position together with projecting shaft elements 54, and is formed with two eccentrics 56, operable by a knurled or otherwise roughened operating portion 58 to, respectively, lock the slider 45′ in the guide 47, or to release it.

The guide 47 is formed by two spring elements, for example the legs of a U-shaped spring element made of spring steel of circular cross section, or other suitable spring elements. Preferably, the spring element 47 is stiffer than the spring element 37. Making the guide element 47 of springy material has the advantage that it also contributes to the overall springiness of the construction, while providing a comparatively stiff backing, yet permitting some yielding.

OPERATION

Let it be assumed that the user leans backwardly, and applies force in the direction of the arrow 60 (FIG. 11) on the upper segment 21 of the back 17. Upon leaning back, the upper portion of the spring element 37, that is, the portion which extends above the slider 45, will be deflected towards the right in FIG. 11. Depending on the vertical position of the slider 45′, the force will be decreased as the slider 45 is lowered. Deflection of the spring element 37 is limited after a certain deflection path by engagement of the stop 36 on the guide 47′. This provides an additional back-up force and the user, upon bending backwards, will not be subjected to the disagreeable sensation that the chair can tilt backwardly without any restraint at all, so that the user might fall backwardly. Since the guide 47, however, preferably also includes a spring element, some slight rocking or deflection of the back is possible, although substantially restrained by the much higher spring constant of the guide element 47. As the rearward deflection continues, the combined restoring forces of both the spring elements 37 and 47 will become effective which, usually, is felt agreeably by the user because it provides for a sensation of security against backward tipping.

Figure 16:
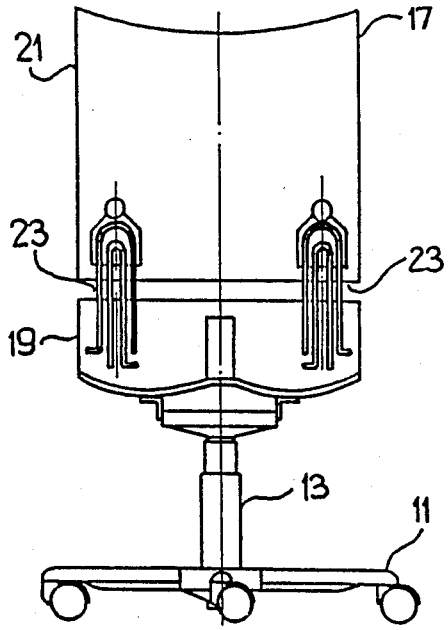
FIG. 16 is a front elevational view in which the spring elements are located at the forward side of the chair back.
Figure 17:
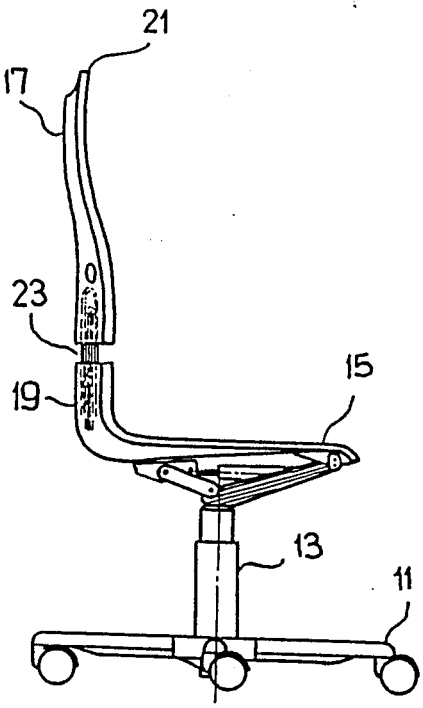
FIG. 17 is a side elevational view of the chair of FIG. 16.
Figure 18:
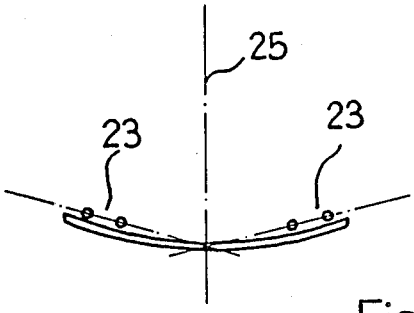
FIG. 18 is a schematic horizontal sectional view through the chair back of FIG. 16 or 17, and illustrating placement of the spring.

Various changes and modifications may be made, and features described in connection with any one of the embodiments can be used with all of them. For example, the spring elements 23 can be located either on the back side, that is behind the user's side of the chair, or at the front side of the chair back, as illustrated in connection with FIGS. 16 to 18. Usually, placing the spring elements at the back side of the has the advantage of better accessibility for adjustment and handling; locating the spring elements at the forward side of the chair, however, has the advantage that the adjustment element 29 (FIGS. 4 to 7) or 29′ (FIGS. 10 to 13) are accessible without reaching around the chair back, and thus can be adjusted more easily by the user. The respective adjustment elements, of course, can be located hidden within the padding of the chair back, to provide a comfortable seat back while permitting pleasant appearance and upholstery.

The respective spring elements 37 and 47′ can be easily released from the respective supports. The latch 52 engaging behind the U-bend of the spring element 37 is particularly suitable (FIGS. 10 and 11), thus permitting ready attachment of the chair segment 21 on top of the chair segment 19. The easy interchangeability of the segments has the advantage that a basic chair can be supplied with a bottom element fixed, and a selection of upper or multiple back elements which can be used by the ultimate customer, as desired, so that different heights of users and different weights can be easily accomodated.

The spring elements, in form of round spring rods, are simple, can be easily made of stock material, and do not require any specific movable hinge parts which might wear. The latch elements can be made of a single plastic molding or of a single sheet-metal stamping.

Adjusting the spring constant by varying the effective length of the spring through which the spring element can become effective is a simple and effective way of controlling the spring force, easily adjustable, and not requiring any complex mechanisms.

Preferably, the length of the respective spring portion of the spring elements is controlled by using a slider which is operable in a slider adjustment path. An engagement spring, fitting into a corrugated or undulating engagement element (FIGS. 4 to 6) is a particularly simple way of maintaining fixed adjustments, ensuring that the spring element and spring strength will be maintained and no undesired shifting will take place. Preferably, an engagement spring fitting into a corrugated track element is secured directly to the slider so that a simple and reliable arrangement is provided. Alternatively, and as described in connection with FIGS. 10 to 13, an eccentric may be used in which, by mere rotation of the eccentric, release and reengagement of the slider is effectively obtained.

The guidance for the slider is obtained by a resilient rod or by a pair of parallel resilient rods, for example one elongated rod bent into U or V shape. Using a second spring rod as the guide element has the additional advantage that it, also, can contribute to the spring characteristics of the adjustment arrangement.

Spring rods of circular cross section are preferred since they are easily available and simple to handle. Further, the arrangement is inexpensive and esthetically acceptable, while avoiding any sharp corners which cannot be readily embedded in cushioning or padding material.

Usually, it is desirable to provide two spring link units, located laterally from each other and on either side of the sagittal plane 25, in order to couple two segments to each other. This provides for high stability of the back. The particular location of the spring elements can be selected as desired, and is not critical. Thus, the spacing of the spring elements, particularly when using round spring rods, can be selected in accordance with criteria of esthetics and ease of manufacture. Likewise, the extent of curvature of the back, that is, whether the back has a highly cradling effect or is only slightly bent, does not affect the utility or applicability of the concept of the present invention. Thus, the back can be shaped as desired by a designer, and no restraints due, for example, to a transversely extending shaft or the like have to be considered.

I claim:

1. Split-back chair, especially office chair, having
a seat (15);
support means (11, 13) to support the seat;
a curved back (17) having at least a lower part (19) and an upper part (21) with a left side and a right side; and
two rod-like spring means (23) of which one is located adjacent the left side and one is located adjacent the right side of the curved back for coupling said lower part and said upper part together while permitting relative yielding movement between said parts,
and comprising, in accordance with the invention,
adjustable means (27) having an adjustment element (29, 29') engageable with said spring means (23) for changing the spring force-deflection characteristics of the spring means.

2. The chair of claim 1, wherein said spring means comprises a spring link (23) including at least one essentially vertically extending elongated rod-like spring element.

3. The chair of claim 2, wherein the back defines a sagittal plane (25) extending essentially vertically;
and wherein two rod-like spring means (23) are provided, located in positions at respectively opposite sides of said sagittal plane.

4. The chair of claim 3, wherein the back (17) is curved;
and a theoretical line at the position of the respective spring means (23) and essentially tangential to the curved back forms an acute angle with said sagittal plane.

5. Split-back chair, especially office chair, having
a seat (15);
support means (11, 13) to support the seat;
a curved back (17) having at least a lower part (19) and an upper part (21); and
two rod-like spring means (23) coupling said lower part and said upper part together while permitting relative yielding movement between said parts,
and comprising, in accordance with the invention,
adjustable means (27) having an adjustment element (29, 29') engageable with said spring means (23) for changing the spring force-deflection characteristics of the spring means; and wherein
each spring means comprises an essentially U-shaped spring element (37) extending essentially vertically
and attachment means (31, 33) attaching, respectively, the free ends or legs of the U-shaped spring elements to one of said parts, and attaching the legs, adjacent the U-bend of the U-shaped elements, to the other of the parts.

6. The chair of claim 5, wherein the essentially U-shaped spring element is removably secured to one of said attachment means, to permit ready assembly and disassembly of said respective back parts.

7. The chair of claim 6, wherein said attachment means includes a latch element (52) and operating means (54) engaging the U-shaped spring elements to the respective parts, or permitting release therefrom.

8. The chair of claim 7, wherein the latch element (52), the operating element (54) and a latch holding element (50) including the respective attachment element form a unitary single assembly adapted for attachment to the respective back part.

9. The chair of claim 5, wherein said essentially U-shaped spring element is rigidly secured to one (31) of said attachment means (31, 33); and
a stop element (45') is provided, longitudinally shiftable by said adjustment element (29, 29') with respect to said attachment means (31) to thereby change the effective operating length of the spring action of said spring element.

10. The chair of claim 9, further including a guide element (11) secured to said one attachment means (31).

11. The chair of claim 10, wherein said guide element comprises at least one elongated rod-like spring element having a stiffer spring constant than said U-shaped spring elements (37).

12. The chair of claim 11, wherein said essentially rod-like guide spring element comprises a second essentially U-shaped guide spring element which is formed with preferably circular cross section.

13. The chair of claim 5, further including position defining means (53, 55) coupled, respectively, to the adjustable means and to the attachment means, to positively determine the relative position of the adjustable means with respect to at least one of said attachment means.

14. The chair of claim 5, further including eccentric means (54,56) coupled to said adjustable element and engageable, respectively, with one of said attachment means, to position the eccentric means and hence the adjustable element with respect to the attachment means in predetermined position upon cam-like engagement of the eccentric means with the attachment means.

15. The chair of claim 5, wherein (FIG. 1) one of said attachment means (31) comprises a plate-like element formed with a longitudinal slit (49);
and wherein said adjustable element (29) comprises a slider (45) and clamping means, clamping the essentially U-shaped spring element in predetermined position on said attachment means, the adjustable element being guided in said slit by a projecting means extending therethrough.

16. The chair of claim 1, wherein the spring means comprise two spring elements (23) extending longitudinally of the chair and connecting said at least two parts together, said respective spring elements being spaced from each other and located at opposite sides of a central plane of symmetry (25) passing longitudinally through the back (17) of the chair.

17. The chair of claim 1, wherein the spring means and the adjustable means are located at the back side of the chair back, with respect to the chair seat.

18. The chair of claim 1, wherein the adjustable means and the spring means are located on the front side of the chair back (17) with respect to the chair seat.

19. Split-back chair, especially office chair, having a seat (15);

support means (11, 13) to support the seat;

a back (17) having at least a lower part (19) and an upper part (21); and a left and a right spring means (23) coupling said lower part and said upper part together while permitting relative yielding movement between said parts, wherein, in accordance with the invention, the spring means comprise at least two elongated rod-like elements, one each located on either side of a central plane (25) passing longitudinally through an axis of symmetry of the chair, and connecting said upper part and said lower part together;

attachment elements (31, 33) are provided on each of said parts, to retain the elongated rod-like elements on said parts;

and means for changing the effective spring length between said attachment elements to change the relative deflection characteristics between said upper part and said lower part.

20. The chair of claim 19, wherein said elongated rod-like spring elements comprise U-shaped spring rods having two open free legs, said free legs being secured by one of said attachment to one of said parts, and having connected legs and a U-bend, the other of said attachment means coupling the U-shaped bend to the other of said chair back parts.

* * * * *